US009765779B2

(12) United States Patent
Ambrosi et al.

(10) Patent No.: US 9,765,779 B2
(45) Date of Patent: Sep. 19, 2017

(54) INTERNAL GEAR PUMP HAVING A ROTATIONALLY FIXED AXIAL DISK

(71) Applicant: Robert Bosch GmbH, Stuttgart (DE)

(72) Inventors: Massimiliano Ambrosi, Benningen (DE); Michael Eisenlauer, Affalterbach (DE); Rene Schepp, Waiblingen (DE); Edgar Kurz, Heilbronn-Horkheim (DE); Norbert Alaze, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/764,385

(22) PCT Filed: Dec. 9, 2013

(86) PCT No.: PCT/EP2013/075892

§ 371 (c)(1),
(2) Date: Jul. 29, 2015

(87) PCT Pub. No.: WO2014/117889

PCT Pub. Date: Aug. 7, 2014

(65) Prior Publication Data

US 2015/0369242 A1 Dec. 24, 2015

(30) Foreign Application Priority Data

Jan. 29, 2013 (DE) ..... 10 2013 201 384

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |

(Continued)

(52) U.S. Cl.
CPC ..... *F04C 15/0003* (2013.01); *F04C 2/08* (2013.01); *F04C 2/084* (2013.01); *F04C 2/101* (2013.01);

(Continued)

(58) Field of Classification Search
CPC ..... F04C 2/084; F04C 2/086; F04C 2/101; F04C 2/102; F04C 15/0026;

(Continued)

(56) References Cited

U.S. PATENT DOCUMENTS

| | | | | |
|---|---|---|---|---|
| 6,053,718 | A | 4/2000 | Schmidt et al. | |
| 2014/0271311 | A1 * | 9/2014 | Schepp | F04C 15/0026 418/132 |

(Continued)

FOREIGN PATENT DOCUMENTS

| | | | | |
|---|---|---|---|---|
| DE | 195 17 296 | A1 | 11/1996 | |
| DE | 102005004657 | A1 * | 8/2006 | F04C 2/101 |

(Continued)

OTHER PUBLICATIONS

International Search Report corresponding to PCT Application No. PCT/EP2013/075892, mailed Aug. 14, 2014 (German and English language document) (7 pages).

*Primary Examiner* — Theresa Trieu
(74) *Attorney, Agent, or Firm* — Maginot, Moore & Beck LLP

(57) ABSTRACT

An internal gear pump for a slip-controlled hydraulic vehicle braking system includes a pump shaft that is mounted rotatably on one side of a pinion and a ring gear that is mounted rotatably in an axial disk. The axial disk seals off the pinion and the ring gear at the sides.

9 Claims, 2 Drawing Sheets

(51) Int. Cl.

| | |
|---|---|
| ***F04C 2/08*** | (2006.01) |
| ***F04C 27/00*** | (2006.01) |
| ***F04C 2/10*** | (2006.01) |
| *F04C 14/26* | (2006.01) |

(52) U.S. Cl.
CPC ..... *F04C 2/102* (2013.01); *F04C 15/0023* (2013.01); *F04C 15/0026* (2013.01); *F04C 15/0038* (2013.01); *F04C 27/005* (2013.01); *F04C 27/006* (2013.01); *F04C 14/265* (2013.01); *F04C 2240/50* (2013.01)

(58) Field of Classification Search
CPC ..... F04C 15/0023; F04C 15/0034; F04C 2240/50; F04C 2240/56; F04C 27/005; F04C 27/006; F01C 21/02; F01C 21/108; F01C 1/102
USPC ..... 418/132–133, 166, 170–171, 102
See application file for complete search history.

(56) References Cited

U.S. PATENT DOCUMENTS

2014/0377114 A1* 12/2014 Alaze ..... F04C 15/0026 418/132
2014/0377115 A1* 12/2014 Biehler ..... F04C 15/0026 418/132

FOREIGN PATENT DOCUMENTS

| | | | | | |
|---|---|---|---|---|---|
| DE | 10 2008 054 758 | A1 | | 6/2010 | |
| DE | 10 2010 005 072 | A1 | | 7/2011 | |
| EP | 2 357 362 | A2 | | 8/2011 | |
| EP | 2 357 363 | A1 | | 8/2011 | |
| JP | 2000145658 | A | * | 5/2000 | ..... F04C 15/0026 |
| JP | 2011-105206 | A | | 6/2011 | |
| WO | 2011/045171 | A2 | | 4/2011 | |

* cited by examiner

INTERNAL GEAR PUMP HAVING A ROTATIONALLY FIXED AXIAL DISK

This application is a 35 U.S.C. §371 National Stage Application of PCT/EP2013/075892, filed on Dec. 9, 2013, which claims the benefit of priority to Serial No. DE 10 2013 201 384.1, filed on Jan. 29, 2013 in Germany, the disclosures of which are incorporated herein by reference in their entirety.

BACKGROUND

The disclosure relates to an internal gear pump for a hydraulic vehicle brake system. The internal gear pump is provided in particular for use in a slip-controlled and/or power-operated vehicle brake system instead of a piston pump usually used therein, which is often, though not necessarily accurately, referred to as a return pump.

The laid-open application DE 195 17 296 A1 discloses an internal gear pump having an annulus and having a pinion which is arranged eccentrically in the annulus such that it meshes with the annulus. The pinion is arranged for conjoint rotation on a pump shaft which serves to drive the pinion in rotation. When driven in rotation, the pinion drives the annulus, with which said pinion meshes, in conjoint rotation, with the result that the internal gear pump is driven and delivers fluid in a manner known per se. The pinion is an externally toothed gearwheel and the annulus is an internally toothed gearwheel, which are referred to here as pinion and annulus for unambiguous designation and to distinguish between them.

At the circumference, the pinion and the annulus delimit, toward the inside and toward the outside, a crescent-shaped pump space between one another, said pump space being covered laterally by rotationally fixed axial disks which bear in a sealing manner against end sides of the pinion and of the annulus. The lateral sealing is not hermetically sealed, the axial disks bear in the manner of plain bearings against the end sides of the pinion and of the annulus, and limited leakage is acceptable. An optimum between low friction and low leakage should be found.

In the circumferential direction, the axial disks extend at least over a pressure region of the pump space. In the axial direction, the axial disks are pressurized on their outer side remote from the pinion and the annulus in what are known as pressure fields and, as a result, are urged into contact against the end sides of the pinion and of the annulus. The pressure field is a usually shallow depression which extends approximately over the pump space or the pressure region of the pump space. Such axial disks are also referred to as pressure disks or control disks or as pressure plates or control plates. They are typically in the form of disks or plates, although this is not essential for the disclosure.

SUMMARY

The internal gear pump according to the disclosure has (at least) one axial disk on an end side of the pinion and of the annulus, said axial disk bearing in a sealing manner against the end side of the pinion and of the annulus. The axial disk is held in a radially fixed manner, for example, in a pump housing and, according to the disclosure, said axial disk has a bearing which rotatably supports a pump shaft. The bearing can be a through hole or else a blind hole in the axial disk, which hole forms a plain bearing. A bearing bushing in the form of a plain bearing or a rolling bearing can also be arranged on the axial disk, for example can be pressed in, preferably into a hole in the axial disk. The list is not definitive. By integrating the bearing in the axial disk, the disclosure makes it possible to shorten the internal gear pump axially or for the internal gear pump to have a short construction axially. The disclosure facilitates the accommodating of an internal gear pump or, in the case of a dual-circuit vehicle brake system, preferably of two internal gear pumps in a hydraulic block of a slip control system of a hydraulic vehicle brake system instead of customary piston pumps. Such hydraulic blocks are known in the case of hydraulic slip-controlled vehicle brake systems; they serve for the mechanical fastening and hydraulic interconnection of hydraulic components of the slip control system. In addition to the customary piston pumps or two of the internal gear pumps described here, such components are solenoid valves, hydraulic accumulators, dampers and the like for the slip control system. The hydraulic block is usually a cuboidal part made of metal, in particular of aluminum, in which cylindrical recesses, often with a stepped diameter, are provided as receptacles for the hydraulic components of the slip control system and in which holes are provided to hydraulically interconnect the receptacles or the components installed therein. An electric motor for driving the pumps is fitted on the hydraulic block. If the hydraulic block is equipped with the hydraulic components and with electrical, electromechanical and electronic components, said hydraulic block forms a hydraulic unit of the slip control system of a hydraulic vehicle brake system.

The internal gear pump according to the disclosure can be configured as what is known as a crescent pump with a dividing element arranged in the pump space between the annulus and the pinion, said dividing element dividing a pressure region from a suction region in the pump space. Such dividing elements are also referred to as filler pieces or, on account of their typical crescent or half-crescent shape, also as crescent pieces. The internal gear pump according to the disclosure can also be configured as an internal gear pump without a dividing element, this pump also being known as a gear ring pump.

The dependent claims relate to advantageous refinements and developments of the disclosure.

In one embodiment, a pressure disk is arranged on an end side of the pinion and of the annulus of the internal gear pump, which is opposite the axial disk and bears there in a sealing manner. The pressure disk and the axial disk can be configured identically or differently; they are referred to here, in particular in the case in which they differ in configuration, as pressure disk and as axial disk for their unambiguous designation and differentiation. The pressure disk is rotationally fixed and axially movable; the axial disk is rotationally fixed and is axially movable with respect to the pinion and the annulus. If the pinion and the annulus are not only rotatable, but are also axially movable, the axial disk can be fixed axially.

In order to urge the pressure disk against the end side of the pinion and of the annulus, the internal gear pump has a pressure field on an outer side of the pressure disk which is remote from the pinion and the annulus. The pressure field can be arranged in the outer side of the pressure disk and/or in a facing inner side of a cover or in an end wall of a pump housing. The pressure field is pressurized at least during operation of the internal gear pump and preferably communicates with the pressure region of the pump space of the internal gear pump. By means of the pressurization in the pressure field, the pressure disk is urged against the end side of the pinion and of the annulus. A pressure field can likewise be provided on the outer side of the axial disk which is remote from the pinion and the annulus; the internal gear pump according to the disclosure preferably does not have a pressure field on the side of the axial disk, i.e. is without a pressure field there. This also makes an internal gear pump of shorter construction axially possible. In addition, a pressure connection of a pressure field on the side of the axial disk is unnecessary, which simplifies the production of the internal gear pump.

In one embodiment, the configuration of the internal gear pump is as an assembly which can be preassembled and, after preassembly, can be handled and installed as a standard unit. The configuration as an assembly makes it possible to check the operating capability of the internal gear pump before the latter is installed in, for example, a hydraulic block. In the event of the internal gear pump being defective, only another internal gear pump need be used and scrapping of a fitted hydraulic block, that is a hydraulic unit, can thus be avoided.

Further features of the disclosure emerge from the description below of an embodiment of the disclosure in conjunction with the features and the drawing. The individual features can in each case be realized by themselves or in a plurality together in embodiments of the disclosure. Embodiments of the disclosure without the axial disk, which has the bearing for the pump shaft, are also conceivable.

BRIEF DESCRIPTION OF THE DRAWINGS

The disclosure is explained in more detail below with reference to an embodiment which is illustrated in the drawings, in which.

DETAILED DESCRIPTION

Figure 1:
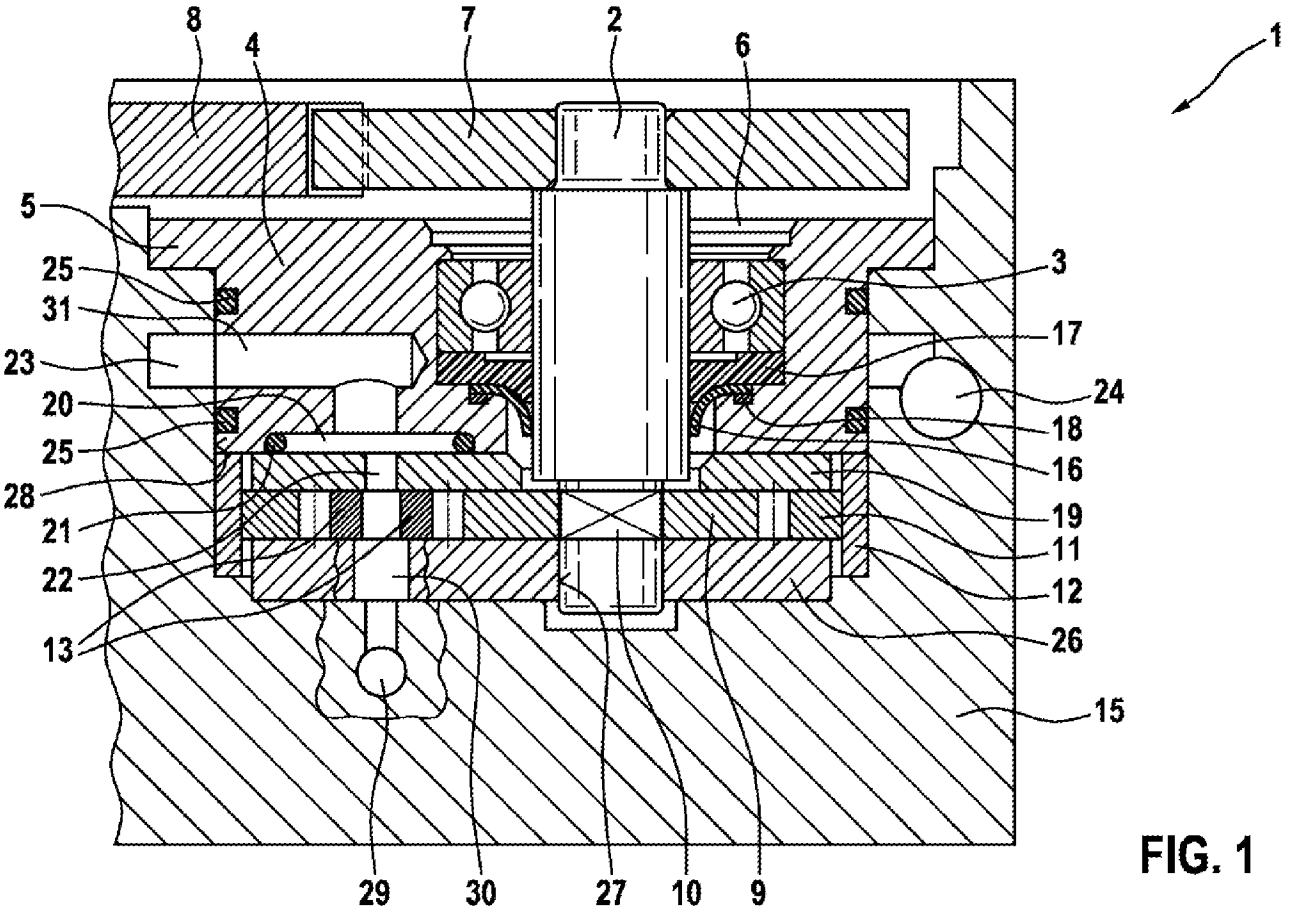
FIG. 1 shows an axial section through an internal gear pump according to the disclosure.

The internal gear pump 1 according to the disclosure and illustrated in FIG. 1 has a pump shaft 2 which is mounted rotatably by means of a bearing, in the embodiment a ball bearing 3, in a cover 4. The cover 4 is a cylindrical part with a flange 5 at one end. Said cover has an axially parallel through-hole 6, which has a multiply stepped diameter, for the pump shaft 2, which is eccentric in the cover 4, to pass through. A gearwheel, referred to here as a drive gear 7, is press-fitted onto one end, projecting from the cover 4, of the pump shaft 2, or is arranged thereon for conjoint rotation in some other way. The drive gear 7 meshes with a gearwheel, which is referred to here as a driving gear 8, which is drivable by means of an electric motor (not illustrated), optionally with the interconnection of a transmission.

On the other side of the ball bearing 3 from the drive gear 7, an externally toothed gearwheel, which is referred to here as the pinion 9, is arranged on the pump shaft 2. The pinion 9 is axially movable and is arranged on the pump shaft 2 for conjoint rotation; in the embodiment, the axial movability and conjoint rotation are achieved by a square 10, although the disclosure is not limited to this option. The pinion 9 is located in an internally toothed gearwheel, referred to here as the annulus 11, which is arranged in the same plane as the pinion 9 and has the same width of the pinion 9. The annulus 11 is coaxial with respect to the cylindrical cover 4 and eccentric with respect to the pump shaft 2 and to the pinion 9, and therefore the pinion 9 and the annulus 11 mesh with each other. When the pinion 9 is driven in rotation with the pump shaft 2, the pinion 9 drives the annulus 11 meshing therewith in conjoint rotation. The annulus 11 is slidingly mounted rotatably in a bearing ring 12.

Figure 2:
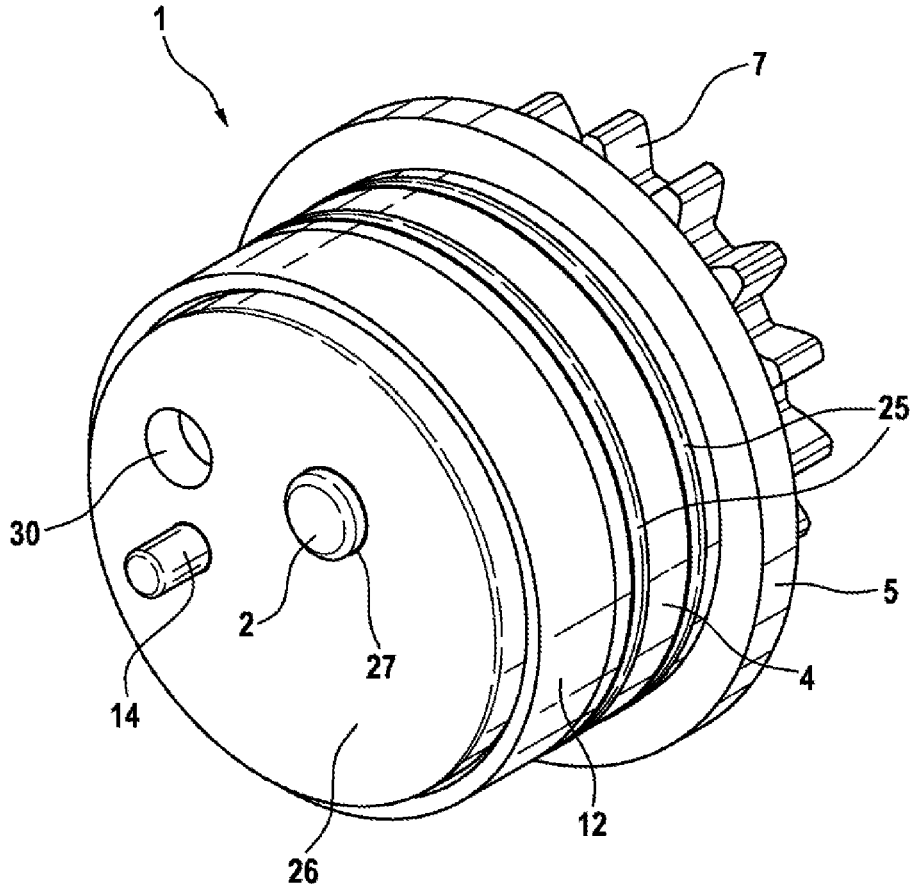
FIG. 2 shows a perspective illustration of the internal gear pump from FIG. 1.

The pinion 9 and the annulus 11 enclose a crescent-shaped pump space between each other in a circumferential section, in which they do not mesh with each other. Arranged in the pump space is a half-crescent-shaped dividing element 13 which divides the pump space into a suction region and a pressure region. The dividing element 13 is the same width as the pinion 9 and the annulus 11. The dividing element 13, which is also referred to as a filler piece or, because of its shape, as a crescent, is a multi-part form in the embodiment; it has an outer part, on the cylindrical outer surface of which tooth tips of teeth of the annulus 11 bear, and an inner part, on the cylindrical inner surface of which tooth tips of teeth of the pinion 9 bear. The dividing element 13 is supported in the circumferential direction on a pin 14 (FIG. 2) which passes through the pump space in an axially parallel manner at an end of the dividing element 13 on the suction region side. One end of the pin 14 is in a blind hole in the cover 4; the other end, which protrudes in FIG. 2, is held in a blind hole in a hydraulic block 15. The pin 14 is located outside the section plane in FIG. 1 and is thus not visible therein. As a result of the pinion 9 and the annulus 11 being driven in rotation, the internal gear pump 1 delivers fluid, in the embodiment brake fluid, from the suction region in tooth gaps of the pinion 9 and of the annulus 11 internally and externally along the dividing element 13 into the pressure region.

Arranged between the ball bearing 3 and the pinion 9 is a sealing arrangement having a sleeve seal 16, a supporting ring 17 and a secondary seal 18 which seals the pump shaft 2 in the cover 4. The sleeve seal 16 is in the shape of a trumpet bell and arranged such that it is urged against the pump shaft 2 in the event of any pressurization. The supporting ring 17, which is located between the ball bearing 3 and the sleeve seal 16, has a concavely curved annular end surface, corresponding to a curvature of the sleeve seal 16, against which the sleeve seal 16 bears. The secondary seal 18 is a sealing ring which is arranged in an end groove of an annular step of the through-hole 6 in the cover 4. The secondary seal 18 is located on an external circumference of the sleeve seal 16 on a side opposite the supporting ring 17 and clamps an outer edge of the sleeve seal 16 between itself and the supporting ring 17.

Located between the sealing arrangement 16, 17, 18 and the pinion 9 and the annulus 11 is a pressure disk 19 which bears against end sides of the pinion 9, of the annulus 11 and of the dividing element 13. The pressure disk 19 has a through-hole for the pump shaft 2, a through-hole for the pin 14 (not visible in FIG. 1) which passes in an axially parallel manner through the pump space between the annulus 11 and the pinion 9 and holds the dividing element 13 in the circumferential direction, and a through-hole 22, through which the pump space communicates with a pressure field 20 and which is part of a pump outlet. The pin 14 also holds the pressure disk 19 in a rotationally fixed manner. In top view, the pressure disk 19 has the form of a circle segment which takes up more than a semicircle, wherein a step has been removed from the circle segment at one corner. The pressure disk 19 covers the dividing element 13 and the pressure region of the pump space on one side.

On an inner side facing the pressure disk 19, i.e. on an outer side of the pressure disk 19 remote from the pinion 9 and the annulus 11, the cover 4 has a pressure field 20. The pressure field 20 is a shallow depression having an approximately half-crescent shape which extends approximately over the pressure region and over part of the dividing element 13. The pressure field 20 is enclosed by a pressure field seal 21 which seals the pressure field 20 between the cover 4 and the pressure disk 19. Instead of, as shown, in the cover 4, the pressure field 20 can also be provided in the outer side of the pressure disk 19 (not illustrated). The pressure disk 19 has a through-hole 22 which leads from the pressure region of the pump space into the pressure field 20. The pressure field 20 communicates through the through-hole 22 with the pressure region of the internal gear pump 1 such that the same pressure prevails in the pressure field 20 as in a pump outlet. On account of the pressurization in the pressure field 20, the pressure disk 19 is urged into sealing contact against the end sides of the pinion 9, of the annulus 11 and of the dividing element 13. The pressure disk 19 bears in the manner of a plain bearing against the end sides of the pinion 9, of the annulus 11 and of the dividing element 13; it does not hermetically seal, and an optimum or at least favorable ratio should be selected between friction between the rotating pinion 9 and the rotating annulus 11, on the one hand, and the rotationally fixed pressure disk 19, on the other hand, and low leakage, which is substantially selectable by means of size, shape and position of the pressure field 20. From the pressure field 20, an angled hole 31 in the cover 4 leads for a short distance axially parallel and subsequently radially outward to a circumference of the cover 4. The through-hole 22 in the pressure disk 19 and the angled hole 31 in the cover 4 are part of a pump outlet of the internal gear pump 1. The angled hole 31 in the cover 4 leads into an annular groove 23 in the hydraulic block 15 (already mentioned), said annular groove enclosing the cover 4 level with the radial part of the angled hole 31. The annular groove 23 is intersected by an outlet hole 24 which is likewise provided in the hydraulic block 15 and which, like the annular groove 23, is part of the pump outlet.

On both sides of the mouth of the angled hole 31 at the circumference of the cover 4, and thus on both sides of the annular groove 23 in the hydraulic block 15, the cover 4 has two sealing rings 25 which are arranged in circumferential grooves in the cover 4 and which provide a seal on both sides of the annular groove 23 between the hydraulic block 15 and the cover 4.

On the opposite side of the pinion 9 and of the annulus 11 from the pressure disk 19, the internal gear pump 1 has an axial disk 26 which bears in a sealing manner against the end sides of the pinion 9, of the annulus 11 and of the dividing element 13. The axial disk 26 is arranged immovably in the hydraulic block 15, i.e. in a manner fixed rotationally, radially and axially. The axial disk 26 is circular. Like the pressure disk 19, the axial disk is passed through by the pin 14 (not visible in FIG. 1) against which the dividing element 13 is supported in the circumferential direction. The pin 14 holds the axial disk 26 for conjoint rotation. The axial disk 26 has an eccentric, cylindrical through-hole which is coaxial with respect to the pump shaft 2 and which forms a bearing 27 in which an end of the pump shaft 2 which is remote from the drive gear 7 is mounted in a sliding manner rotatably. For the sliding mounting of the pump shaft 2, a plain bearing bushing (not illustrated) can be pressed into the bearing hole 27 in the axial disk 26 or fastened there in some other manner. A rolling mounting of the pump shaft 2 by means of a rolling bearing (not illustrated) in the axial disk 26 is also possible.

As a result of the pressurization of the outer side of the pressure disk 19 in the pressure field 20, the axially movable pressure disk 19 is urged against the end sides of the pinion 9, of the annulus 11 and of the dividing element 13, and the end sides of the axially movable pinion 9, of the axially movable annulus 11 and of the dividing element 13 which are remote from the pressure disk 19 are urged against the facing inner side of the axial disk 26 such that the end sides of the pinion 9, of the annulus 11 and of the dividing element 13 also bear in a sealing manner against the axial disk 26. Here too, the contact is in the manner of a plain bearing, and the sealing is not hermetic, but exhibits leakage.

The internal gear pump 1 is an assembly which can be preassembled and the function of which can be tested before it is installed in the hydraulic block 15. The hydraulic block 15 has a stepped blind hole as a receptacle 28 for the internal gear pump 1, into which the gear pump 1 is inserted and is secured, for example, by calking. The hydraulic block 15 is part of a slip control system (not illustrated) of a hydraulic vehicle brake system. The hydraulic block 15 is a cuboidal part made of aluminum alloy, which has a second recess as a receptacle 28 for a second internal gear pump 1 and further recesses for hydraulic components of the slip control system. Such components are (not illustrated) solenoid valves and hydraulic accumulators. The abovementioned electric motor (not shown) is flanged onto the outside of the hydraulic block 15, the driving gear 8 being fitted onto the motor shaft of said electric motor or onto a transmission shaft of a transmission flanged onto the electric motor, said driving gear 8 driving the two internal gear pumps 1 via the drive gears 7. The receptacles for the hydraulic components are connected together by holes in the hydraulic block 15, as a result of which the hydraulic components (not illustrated) of the slip control system are hydraulically interconnected. Equipped with the hydraulic components and provided with the electric motor and with further electrical, electromechanical and electronic components, the hydraulic block 15 forms a hydraulic unit and a slip control unit of the hydraulic vehicle brake system.

A pump inlet 29 takes place at a base of the blind hole which forms the receptacle 28 for the internal gear pump 1: a hole which forms the pump inlet 29 opens there. The pump inlet takes place through a through-hole 30 in the axial disk 26 into the suction region of the pump space of the internal gear pump 1. The through-hole 30 in the axial disk 26 is part of the pump inlet 29. The pump inlet 29, 30 is illustrated in the drawing in a manner rotated into the sectional plane; actually, the pump inlet is angularly offset by more than 90° with respect to the pump outlet 22, and the pump inlet 29, 30 and the pump outlet 22 are located on opposite sides of the dividing element 13 in the circumferential direction. A dedicated sealing of the pump inlet 29 is not necessary; the one encircling seal 25 on the cover 4 on that side of the mouth of the pump outlet 22 which faces the base of the receptacle 28 for the internal gear pump 1 or of the encircling angular groove 23 in the circumference of the receptacle 28, which forms part of the pump outlet, is sufficient.

The invention claimed is:

1. An internal gear pump for a hydraulic vehicle brake system, comprising:

a pump shaft;

a pinion arranged on and configured for conjoint rotation with the pump shaft;

an annulus that meshes with the pinion;

a rotationally fixed axial disk that is arranged on and bears in a sealing manner against an end side of the pinion and of the annulus, wherein the axial disk is fixed radially and includes a bearing that rotatably supports the pump shaft; and a pressure disk on a first side of the pinion and the annulus opposite the axial disk, the pressure disk being rotationally fixed and axially movable, wherein:

the axial disk is axially movable with respect to the pinion and the annulus, a pressure field is defined on an outer side of the pressure disk opposite the pinion and the annulus, the pressure field urging the pressure disk against the first side of the pinion and the annulus when the pressure field is pressurized.

2. The internal gear pump as claimed in claim 1, wherein the axial disk rotatably supports the pump shaft on a side of the pinion opposite the pump shaft.

3. The internal gear pump as claimed in claim 1, further comprising a sealing sleeve that seals against the pump shaft.

4. The internal gear pump as claimed in claim 3, further comprising a supporting disk arranged on a side of the sealing sleeve opposite the pinion and annulus, the supporting disk axially supporting the sealing sleeve.

5. The internal gear pump as claimed in claim 1, wherein the further comprising a cover defining a pump outlet that opens on a circumference of the cover.

6. The internal gear pump as claimed in claim 5, further comprising an encircling seal on each axial side of a mouth opening of the pump outlet.

7. The internal gear pump as claimed in claim 5, wherein the cover is arranged on a side of the pinion and annulus opposite the axial disk.

8. The internal gear pump as claimed in claim 1, wherein a pump inlet is defined through the axial disk.

9. The internal gear pump as claimed in claim 1, wherein the internal gear pump forms an assembly formed as a preassembled standard unit.

* * * * *